US012729620B2

(12) United States Patent
Zhao et al.

(10) Patent No.: US 12,729,620 B2
(45) Date of Patent: Sep. 8, 2026

(54) BOREHOLE FRACTURE-DEFORMATION-WAVE VELOCITY INTEGRATED INTELLIGENT SENSING APPARATUS AND METHOD FOR ENGINEERING ROCK MASS

(71) Applicant: Northeastern University, Shenyang (CN)

(72) Inventors: Jun Zhao, Shenyang (CN); Xiating Feng, Shenyang (CN); Mengfei Jiang, Shenyang (CN); Jiachao Xue, Shenyang (CN); Chengxiang Yang, Shenyang (CN)

(73) Assignee: Northeastern University, Shenyang (CN)

( * ) Notice: Subject to any disclaimer, the term of this patent is extended or adjusted under 35 U.S.C. 154(b) by 355 days.

(21) Appl. No.: 18/598,189

(22) Filed: Mar. 7, 2024

(65) Prior Publication Data

US 2024/0384643 A1 Nov. 21, 2024

Related U.S. Application Data

(63) Continuation of application No. PCT/CN2023/094972, filed on May 18, 2023.

(30) Foreign Application Priority Data

May 16, 2023 (CN) ..... 202310546788.5

(51) Int. Cl.
*E21B 47/002* (2012.01)
*E21B 7/02* (2006.01)

(52) U.S. Cl.
CPC ..... *E21B 47/002* (2020.05); *E21B 7/02* (2013.01)

(58) Field of Classification Search
CPC ..... E21B 47/002; E21B 47/0025
See application file for complete search history.

(56) References Cited

U.S. PATENT DOCUMENTS 7,143,843 B2 * 12/2006 Doering ..... E21B 4/18 175/94
9,644,475 B2 * 5/2017 Forsberg ..... H04L 67/12
(Continued)

FOREIGN PATENT DOCUMENTS

CN 103737589 A * 4/2014 ..... B25J 9/1697
CN 105717200 B * 4/2019 ..... G01N 29/265
(Continued)

*Primary Examiner* — Herbert K Roberts
(74) *Attorney, Agent, or Firm* — George D. Morgan

(57) ABSTRACT

Disclosed are a borehole fracture-deformation-wave velocity integrated intelligent sensing apparatus and method for an engineering rock mass. The apparatus includes an in-hole monitoring execution unit and an out-hole monitoring unit which are connected by a cable; the in-hole monitoring execution unit includes a hole-diameter-adaptive crawling robot and a combined multifunctional probe assembly; the probe assembly includes a high-definition wide-angle camera, a laser radar probe, and an acoustic transceiver probe, and all the probes may be freely combined; the hole-diameter-adaptive crawling robot is of a waterproof sealed shell structure and is capable of charging a pressure inside to realize leakage detection, and the hole-diameter-adaptive crawling robot adopts lift-type electric crawler walking mechanisms capable of automatically adjusting a supporting force to avoid sliding. The apparatus can be used for intelligent long-term monitoring of borehole fracture, deformation and wave velocity.

2 Claims, 8 Drawing Sheets

(56) References Cited

U.S. PATENT DOCUMENTS

| | | | | |
|---|---|---|---|---|
| 2007/0070811 | A1* | 3/2007 | Castillo | G01V 1/40 367/69 |
| 2013/0118746 | A1* | 5/2013 | Delp | E21B 43/2401 166/302 |
| 2014/0102796 | A1* | 4/2014 | Veneruso | E21B 47/017 175/57 |
| 2014/0260590 | A1* | 9/2014 | Gerrie | E21B 47/002 73/152.54 |
| 2016/0040509 | A1* | 2/2016 | Castillo | E21B 17/028 166/244.1 |
| 2021/0173108 | A1* | 6/2021 | Tang | G01V 1/003 |
| 2021/0262343 | A1* | 8/2021 | Dupont | E21B 33/1243 |
| 2022/0171403 | A1* | 6/2022 | Dong | F16L 55/28 |
| 2023/0128787 | A1* | 4/2023 | Chen | G01V 1/42 348/159 |
| 2023/0140874 | A1* | 5/2023 | Zhu | E21B 43/26 166/250.1 |

FOREIGN PATENT DOCUMENTS

| | | | | |
|---|---|---|---|---|
| CN | 215927397 | U | * | 3/2022 |
| CN | 115012814 | A | | 9/2022 |
| CN | 116910939 | A | | 10/2023 |

* cited by examiner

BOREHOLE FRACTURE-DEFORMATION-WAVE VELOCITY INTEGRATED INTELLIGENT SENSING APPARATUS AND METHOD FOR ENGINEERING ROCK MASS

CROSS-REFERENCE TO RELATED APPLICATIONS

The application claims priority to Chinese patent application No. 2023105467885, filed on May 16, 2023, the entire contents of which are incorporated herein by reference.

TECHNICAL FIELD

The present disclosure belongs to the technical field of geotechnical engineering disaster monitoring, in particular relates to a borehole fracture-deformation-wave velocity integrated intelligent sensing apparatus and method for an engineering rock mass.

BACKGROUND

With the continuous development of metal mines, traffic tunnels, water conservancy and hydropower engineering to the deep, a deep high ground stress makes disasters such as rock burst, wall caving and landslides occur frequently. In order to early warn the occurrence level, time and position of underground engineering disasters, in-situ monitoring for a rock mass has become the most commonly used method. By in-situ monitoring for the rock mass, information on fracture, deformation and a wave velocity of the rock mass during excavation and operation can be obtained to cognize an evolution rule of the deformation, the fracture and the wave velocity in an engineering disaster generation process, thereby establishing a corresponding early warning method for engineering disasters. The most commonly used monitoring measures include monitoring borehole fracture evolution of the rock mass by a TV camera, monitoring deformation evolution by pre-burying a multi-point displacement meter in a borehole of the rock mass, measuring a relaxation depth in the borehole of the rock mass by means of the wave velocity, etc.

However, there are following defects in traditional measurement for the deformation, fracture and wave velocity of an underground engineering rock mass:

① Key data for the disaster generation process cannot be measured due to discontinuous collection of the data.

Existing monitoring equipment for the deformation, the fracture and the wave velocity needs to be manually operated when the data is collected every time, during tunnel blasting, in order to guarantee the safety of personnel, a working staff has to leave away from a site, which causes incapability of collecting the data within the first time; and the occurrence time and position of an underground disaster are uncertain, which may also cause incapability of measuring the key data in the disaster generation process.

② A mechanism of the disaster generation process is not cognized clearly due to incapability of synchronously monitoring the deformation, the fracture and the wave velocity.

At present, since deformation in the rock mass is mainly measured by burying the multi-point displacement meter, additional boreholes are required for wave velocity and fracture monitoring, but deformation data and fracture data are not from the same borehole, which will cause incapability of comparing the deformation data with the fracture data, and further affect accurate cognition for the mechanism of the disaster generation process.

SUMMARY

For problems existing in the prior art, the present disclosure provides a borehole fracture-deformation-wave velocity integrated intelligent sensing apparatus and method for an engineering rock mass, by which synchronous, long-term and continuous monitoring for borehole fracture-deformation-wave velocity of the engineering rock mass can be realized, a requirement for unmanned intelligent monitoring can be satisfied, underground engineering disasters can be better early warned, and more accurate cognition for a mechanism of a disaster generation process can be realized.

In order to achieve the above-mentioned object, the present disclosure adopts the following technical solution: provided is a borehole fracture-deformation-wave velocity integrated intelligent sensing apparatus for an engineering rock mass, including an in-hole monitoring execution unit and an out-hole monitoring unit which are connected by a cable.

The in-hole monitoring execution unit includes a hole-diameter-adaptive crawling robot and a combined multifunctional probe assembly; the combined multifunctional probe assembly is connected to a front end of the hole-diameter-adaptive crawling robot by a quick joint, and a rear end of the hole-diameter-adaptive crawling robot is connected to the cable.

The combined multifunctional probe assembly includes a high-definition wide-angle camera, a laser radar probe, and an acoustic transceiver probe; the high-definition wide-angle camera is fixedly installed with a male end of the quick joint, and the hole-diameter-adaptive crawling robot is fixedly installed with a female end of the quick joint; the high-definition wide-angle camera is installed in a transparent protective cover in a sealing way; and the laser radar probe and the acoustic transceiver probe are fixed in a way of serial connection to a front end of the transparent protective cover of the high-definition wide-angle camera by an adapter, or each of the laser radar probe and the acoustic transceiver probe is independently fixed to the front end of the transparent protective cover of the high-definition wide-angle camera by the adapter.

The hole-diameter-adaptive crawling robot adopts lift-type electric crawler walking mechanisms to realize the hole-diameter-adaptive crawling movement of the robot in a borehole, and the lift-type electric crawler walking mechanisms are of waterproof sealed shell structures; and a robot body of the hole-diameter-adaptive crawling robot is of a waterproof sealed shell structure.

An air pressure sensor is disposed in the robot body of the hole-diameter-adaptive crawling robot, a charging nozzle is disposed on the rear of a robot body shell of the hole-diameter-adaptive crawling robot, a sealed cavity in the robot body of the hole-diameter-adaptive crawling robot is in a pressure charging state and communicates with the inside of the transparent protective cover, and a charged pressure value is 1.2 bar to 1.6 bar; a charged pressure of the sealed cavity in the robot body of the hole-diameter-adaptive crawling robot is detected in real time by the air pressure sensor, and measured data from the air pressure sensor is transmitted to the out-hole monitoring unit by the cable; when a real-time pressure value measured by the air pressure sensor ranges from 1.2 bar to 1.6 bar, it is proven that the sealed cavity in the robot body of the hole-diameter-adaptive crawling robot is in a good sealed state; and if the real-time pressure value measured by the air pressure sensor is lower than 1.2 bar, it is proven that a pressure leakage point exists on the robot body of the hole-diameter-adaptive crawling robot, at the moment, the out-hole monitoring unit gives an alarm, so that a working staff deals with seal leakage at the first time.

A controller and a pressure sensor are disposed in each of the lift-type electric crawler walking mechanisms, a supporting force N from the lift-type electric crawler walking mechanism to a wall of the borehole is detected in real time by the pressure sensor, measured data from the pressure sensor is directly transmitted to the inside of the controller, and the supporting force N is automatically converted into a real-time friction F between the lift-type electric crawler walking mechanism and the wall of the borehole by the controller; and the minimum allowable friction $F_{min}$ for preventing the lift-type electric crawler walking mechanism from sliding is prewritten into the controller, the minimum allowable friction $F_{min}$ is compared with the real-time friction F by the controller, when $F>F_{min}$, the supporting force N can be maintained unchanged, and when $F<F_{min}$, the lift-type electric crawler walking mechanism is adjusted by the controller to increase the supporting force N until $F>F_{min}$.

The cable is of an integrated structure, and cable lines and a water pipe are integrated in a sheath of the cable; the cable lines are configured to transmit control instructions and monitoring data between the in-hole monitoring execution unit and the out-hole monitoring unit; and the water pipe is configured to inject clear water into the borehole during wave velocity monitoring.

The out-hole monitoring unit is fixedly installed in a tunnel in a form of an equipment cabinet, an industrial personal computer is disposed in the equipment cabinet, and the cable lines are connected to the industrial personal computer; the industrial personal computer is configured with a wireless data transmission module and is remotely connected to a master control system in a tunnel supervision room by the wireless data transmission module; and data produced by the hole-diameter-adaptive crawling robot and the combined multifunctional probe assembly is transmitted to the industrial personal computer by the cable lines, is remotely transmitted to the master control system in the tunnel supervision room in a wireless transmission mode after being collected by the industrial personal computer, and is collected and analyzed by the master control system.

The master control system in the downhole supervision room collects data in three modes which are respectively a mode of collecting data at time intervals, a mode of collecting data according to input time and a mode of continuously collecting data in real time.

Provided is a borehole fracture-deformation-wave velocity integrated monitoring method for an engineering rock mass, in which the borehole fracture-deformation-wave velocity integrated intelligent sensing apparatus for the engineering rock mass is adopted, wherein the method includes the following steps:

step 1: machining a borehole in a side wall of a tunnel, next, disposing a plurality of cable guide pulleys in a height direction of the side wall of the tunnel under the borehole, then, installing an equipment cabinet on the tunnel ground under the borehole, and then, installing an industrial personal computer and a cable reel on the equipment cabinet;

step 2: connecting one end of a cable to a hole-diameter-adaptive crawling robot, on the other end of the cable, connecting cable lines to the industrial personal computer by the cable reel, and then, installing a combined multifunctional probe assembly on a front end of the hole-diameter-adaptive crawling robot;

step 3: turning on a power supply, and debugging the industrial personal computer, the hole-diameter-adaptive crawling robot and the combined multifunctional probe assembly to ensure normal work and also ensure that the industrial personal computer can be normally and remotely connected to a master control system in a tunnel supervision room;

step 4: putting the hole-diameter-adaptive crawling robot installed with the combined multifunctional probe assembly into the borehole, and then, controlling two lift-type electric crawler walking mechanisms of the hole-diameter-adaptive crawling robot to unfold in the radial direction until the hole-diameter-adaptive crawling robot is stably supported on a wall of the borehole by means of a friction;

step 5: remotely sending a monitoring starting instruction by the master control system in the tunnel supervision room, after receiving the instruction, starting, by the hole-diameter-adaptive crawling robot, to advance at a constant speed in the axial direction of the borehole 10, during movement, monitoring borehole fracture by a high-definition wide-angle camera, at the same time, monitoring borehole deformation by a laser radar probe, and after the hole-diameter-adaptive crawling robot moves to the bottom of the hole, ending information collection, and controlling the hole-diameter-adaptive crawling robot to retreat to an orifice;

step 6: firstly, plugging the orifice of the borehole to seal the hole-diameter-adaptive crawling robot in the borehole, then, injecting clear water into the sealed borehole by a water pipe until the borehole is filled with the clear water, then, further remotely sending the monitoring starting instruction by the master control system in the tunnel supervision room, advancing, by the hole-diameter-adaptive crawling robot, in water at a constant speed in the axial direction of the borehole, during movement, monitoring a borehole wave velocity by an acoustic transceiver probe, and after the hole-diameter-adaptive crawling robot moves to the bottom of the hole, ending information collection, and controlling the hole-diameter-adaptive crawling robot to retreat to the orifice;

step 7: firstly, draining water in the borehole, next, unplugging the orifice of the borehole, then, controlling the two lift-type electric crawler walking mechanisms of the hole-diameter-adaptive crawling robot to retract in the radial direction to remove support and fixation between the hole-diameter-adaptive crawling robot and the wall of the borehole, then, moving the hole-diameter-adaptive crawling robot and the combined multifunctional probe assembly out of the borehole, and finally, analyzing and processing data collected by the master control system in the tunnel supervision room.

The present disclosure has the beneficial effects:

by using the borehole fracture-deformation-wave velocity integrated intelligent sensing apparatus and method for the engineering rock mass in the present disclosure, synchronous, long-term and continuous monitoring for borehole fracture-deformation-wave velocity of the engineering rock mass can be realized, a requirement for unmanned intelligent monitoring can be satisfied, underground engineering disasters can be better early warned, and more accurate cognition for a mechanism of a disaster generation process can be realized.

in which, 1—cable, 2—hole-diameter-adaptive crawling robot, 3—quick joint, 4—high-definition wide-angle camera, 5—laser radar probe, 6—acoustic transceiver probe, 7—transparent protective cover, 8—adapter, 9—lift-type electric crawler walking mechanism, 10—borehole, 11—sheath, 12—cable line, 13—water pipe, 14—equipment cabinet, 15—lighting lamp, 16—balancing weight, and 17—cable guide pulley.

DETAILED DESCRIPTION OF THE EMBODIMENTS

The present disclosure will be further described in detail below in conjunction with the accompanying drawings and specific embodiments.

Figure 1:
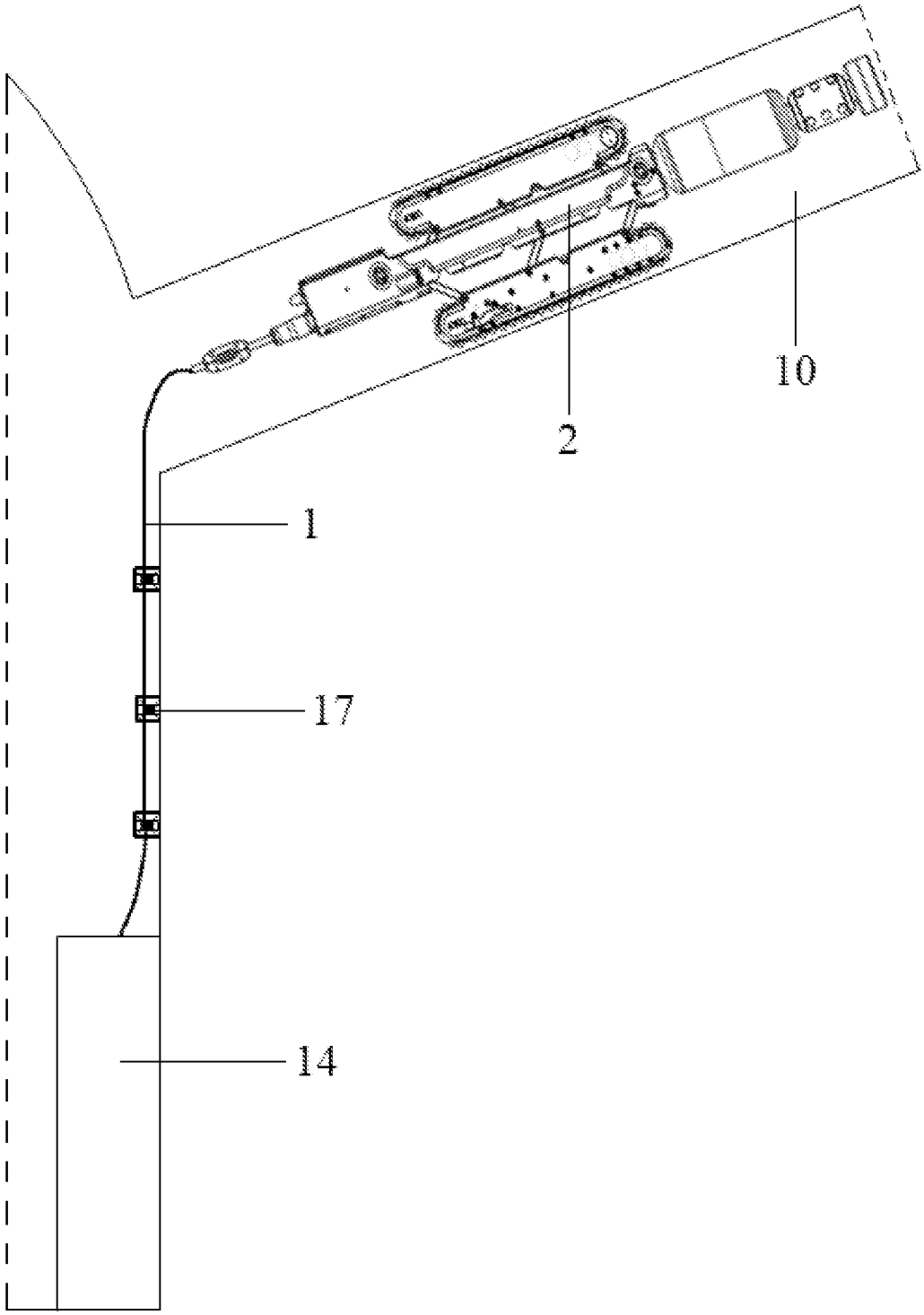
FIG. 1 is a schematic structural diagram of a borehole fracture-deformation-wave velocity integrated intelligent sensing apparatus for an engineering rock mass in the present disclosure.
Figure 2:
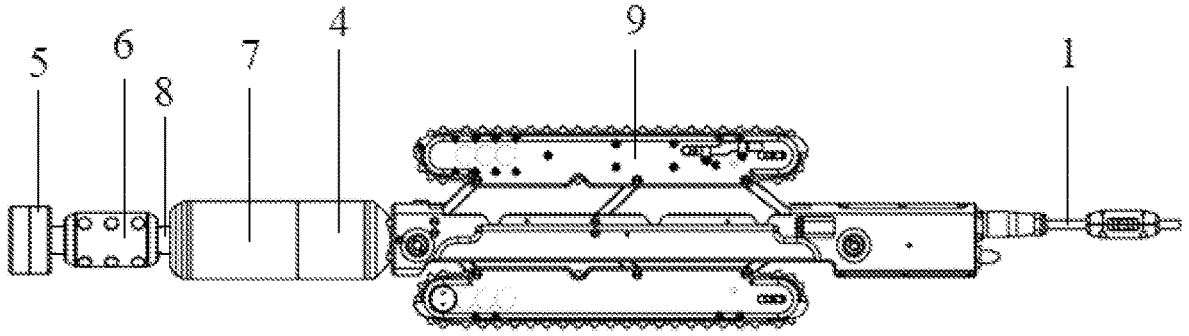
FIG. 2 is a schematic structural diagram of an in-hole monitoring execution unit (a solution that a high-definition wide-angle camera, an acoustic transceiver probe and a laser radar probe are connected in series) in the present disclosure.
Figure 3:
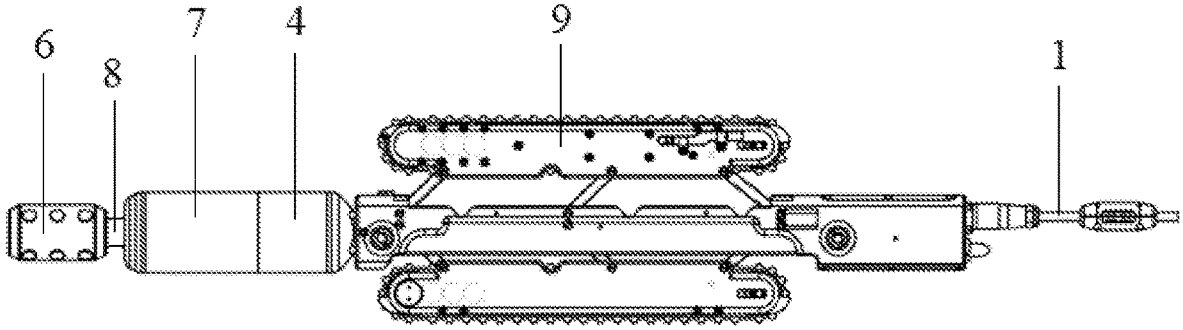
FIG. 3 is a schematic structural diagram of an in-hole monitoring execution unit (a solution that a high-definition wide-angle camera and an acoustic transceiver probe are connected in series) in the present disclosure.
Figure 4:
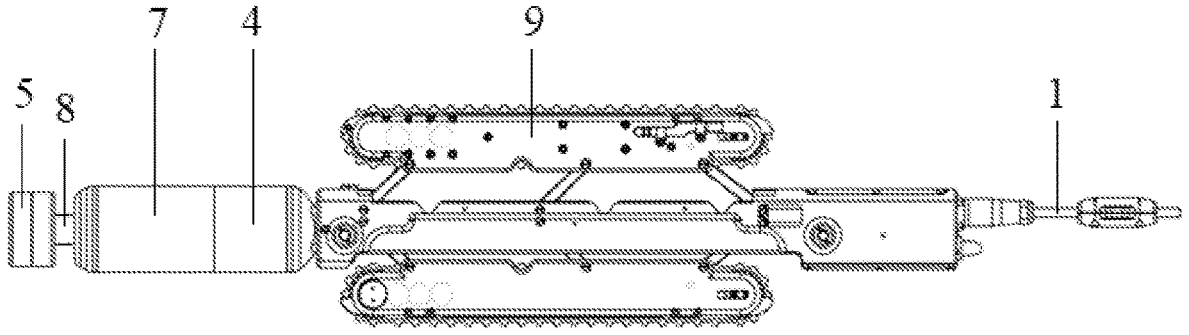
FIG. 4 is a schematic structural diagram of an in-hole monitoring execution unit (a solution that a high-definition wide-angle camera and a laser radar probe are connected in series) in the present disclosure.
Figure 5:
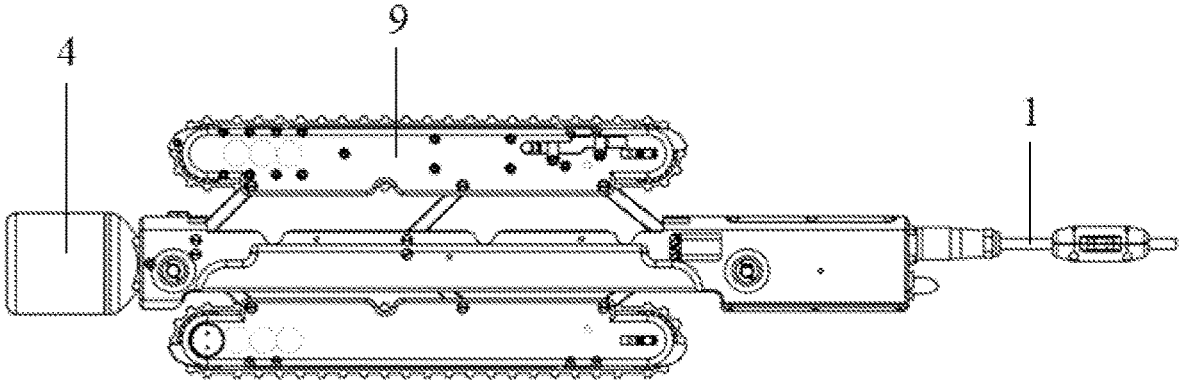
FIG. 5 is a schematic structural diagram of an in-hole monitoring execution unit (a solution that a high-definition wide-angle camera is disposed alone) in the present disclosure.
Figure 6:
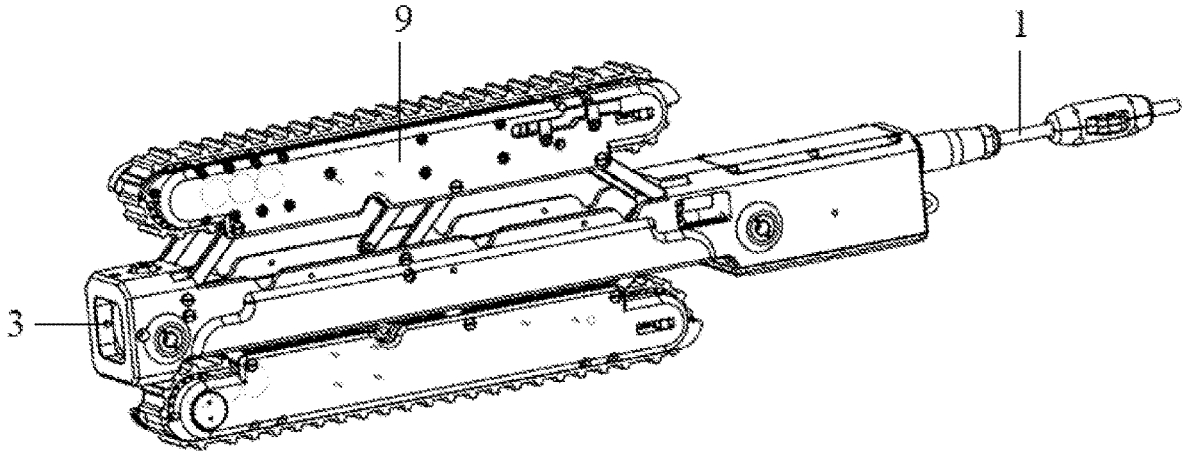
FIG. 6 is a schematic structural diagram of a hole-diameter-adaptive crawling robot in the present disclosure.
Figure 7:
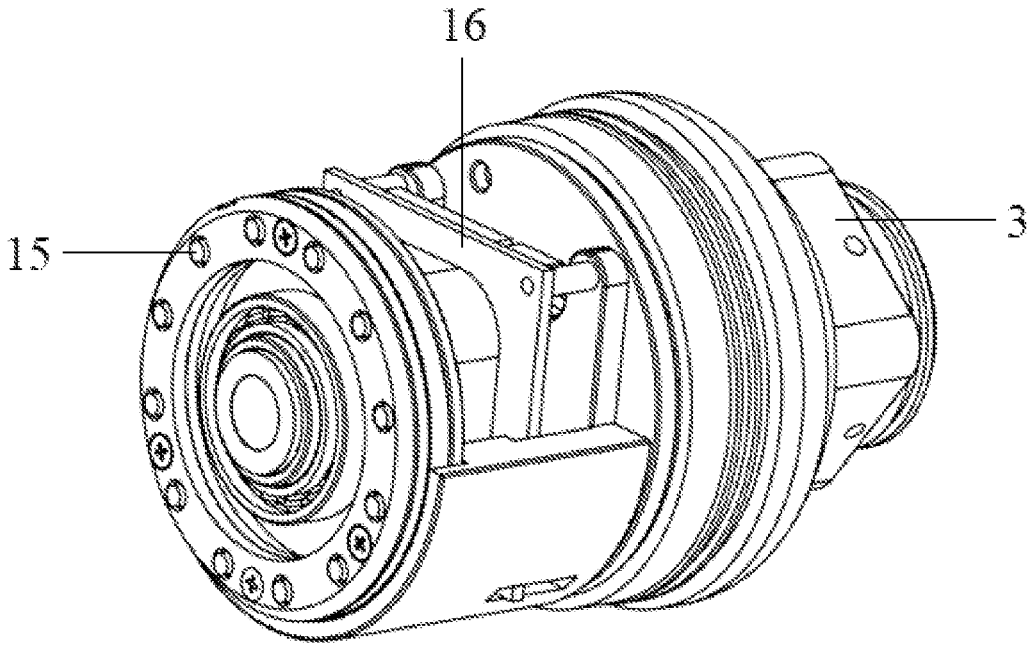
FIG. 7 is a schematic structural diagram of a high-definition wide-angle camera (of which a transparent protective cover is not shown) in the present disclosure.
Figure 8:
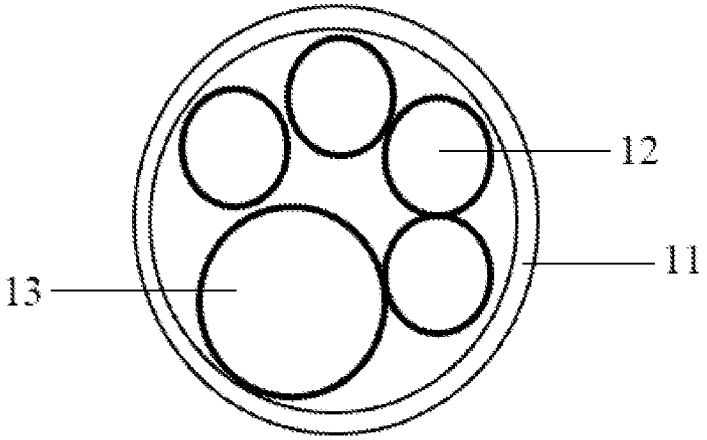
FIG. 8 is a schematic structural diagram of a cable (section) in the present disclosure.

As shown in FIGS. 1 to 8, provided is a borehole fracture-deformation-wave velocity integrated intelligent sensing apparatus for an engineering rock mass, including an in-hole monitoring execution unit and an out-hole monitoring unit which are connected by a cable 1.

The in-hole monitoring execution unit includes a hole-diameter-adaptive crawling robot 2 and a combined multifunctional probe assembly; the combined multifunctional probe assembly is connected to a front end of the hole-diameter-adaptive crawling robot 2 by a quick joint 3, and a rear end of the hole-diameter-adaptive crawling robot 2 is connected to the cable 1.

The combined multifunctional probe assembly includes a high-definition wide-angle camera 4, a laser radar probe 5, and an acoustic transceiver probe 6; the high-definition wide-angle camera 4 is fixedly installed with a male end of the quick joint 3, and the hole-diameter-adaptive crawling robot 2 is fixedly installed with a female end of the quick joint 3; the high-definition wide-angle camera 4 is installed in a transparent protective cover 7 in a sealing way; and the laser radar probe 5 and the acoustic transceiver probe 6 are fixed in a way of serial connection to a front end of the transparent protective cover 7 of the high-definition wide-angle camera 4 by an adapter 8, or each of the laser radar probe 5 and the acoustic transceiver probe 6 is independently fixed to the front end of the transparent protective cover 7 of the high-definition wide-angle camera 4 by the adapter 8. Specifically, the high-definition wide-angle camera 4 is equipped with in-hole lighting lamps 15 and is also equipped with a balancing weight 16, and after the high-definition wide-angle camera 4 enters the borehole 10 along with the hole-diameter-adaptive crawling robot 2, it can be ensured that a forward photographing direction of the high-definition wide-angle camera 4 is always parallel to the direction of a plumb line of the ground.

The hole-diameter-adaptive crawling robot 2 adopts lift-type electric crawler walking mechanisms 9 to realize the hole-diameter-adaptive crawling movement of the robot in a borehole 10, and the lift-type electric crawler walking mechanisms 9 are of waterproof sealed shell structures; and a robot body of the hole-diameter-adaptive crawling robot 2 is of a waterproof sealed shell structure.

An air pressure sensor is disposed in the robot body of the hole-diameter-adaptive crawling robot 2, a charging nozzle is disposed on the rear of a robot body shell of the hole-diameter-adaptive crawling robot 2, a sealed cavity in the robot body of the hole-diameter-adaptive crawling robot 2 is in a pressure charging state and communicates with the inside of the transparent protective cover 7, and a charged pressure value is 1.2 bar to 1.6 bar; a charged pressure of the sealed cavity in the robot body of the hole-diameter-adaptive crawling robot 2 is detected in real time by the air pressure sensor, and measured data from the air pressure sensor is transmitted to the out-hole monitoring unit by the cable 1; when a real-time pressure value measured by the air pressure sensor ranges from 1.2 bar to 1.6 bar, it is proven that the sealed cavity in the robot body of the hole-diameter-adaptive crawling robot 2 is in a good sealed state; and if the real-time pressure value measured by the air pressure sensor is lower than 1.2 bar, it is proven that a pressure leakage point exists on the robot body of the hole-diameter-adaptive crawling robot 2, at the moment, the out-hole monitoring unit gives an alarm, so that a working staff deals with seal leakage at the first time. Specifically, during wave velocity monitoring, the borehole 10 needs to be sealed and filled with water, and if the pressure leakage point exists on the robot body of the hole-diameter-adaptive crawling robot 2, the water in the borehole 10 will penetrate into the robot body through the pressure leakage point, and thus, it is possible that the hole-diameter-adaptive crawling robot 2 is damaged. In order to avoid such a situation, the working staff needs to cut off power supplied to the hole-diameter-adaptive crawling robot 2 firstly, and then rapidly drain the water in the borehole 10 to prevent the hole-diameter-adaptive crawling robot 2 from being soaked into the water for a long term, thereby guaranteeing the safety of the hole-diameter-adaptive crawling robot 2; after the water in the borehole 10 is drained, the hole-diameter-adaptive crawling robot 2 may exit out of the hole, and the leakage point is found, so that the sealing property of the hole-diameter-adaptive crawling robot 2 is restored, wherein a pressure charging gas is preferably nitrogen; and then, wave velocity monitoring work may be further performed.

A controller and a pressure sensor are disposed in each of the lift-type electric crawler walking mechanisms 9, a supporting force N from the lift-type electric crawler walking mechanism 9 to a wall of the borehole 10 is detected in real time by the pressure sensor, measured data from the pressure sensor is directly transmitted to the inside of the controller, and the supporting force N is automatically converted into a real-time friction F between the lift-type electric crawler walking mechanism 9 and the wall of the borehole 10 by the controller; and the minimum allowable friction $F_{min}$ for preventing the lift-type electric crawler walking mechanism 9 from sliding is prewritten into the controller, the minimum allowable friction $F_{min}$ is compared with the real-time friction F by the controller, when $F>F_{min}$, the supporting force N can be maintained unchanged, and when $F<F_{min}$, the lift-type electric crawler walking mechanism 9 is adjusted by the controller to increase the supporting force N until $F>F_{min}$.

The cable 1 is of an integrated structure, and cable lines 12 and a water pipe 13 are integrated in a sheath 11 of the cable 1; the cable lines 12 are configured to transmit control instructions and monitoring data between the in-hole monitoring execution unit and the out-hole monitoring unit; and the water pipe 13 is configured to inject clear water into the borehole 10 during wave velocity monitoring.

The out-hole monitoring unit is fixedly installed in a tunnel in a form of an equipment cabinet 14, an industrial personal computer is disposed in the equipment cabinet 14, and the cable lines 12 are connected to the industrial personal computer; the industrial personal computer is configured with a wireless data transmission module and is remotely connected to a master control system in a tunnel supervision room by the wireless data transmission module; and data produced by the hole-diameter-adaptive crawling robot 2 and the combined multifunctional probe assembly is transmitted to the industrial personal computer by the cable lines 12, is remotely transmitted to the master control system in the tunnel supervision room in a wireless transmission mode after being collected by the industrial personal computer, and is collected and analyzed by the master control system.

The master control system in the downhole supervision room collects data in three modes which are respectively a mode of collecting data at time intervals, a mode of collecting data according to input time and a mode of continuously collecting data in real time.

Provided is a borehole fracture-deformation-wave velocity integrated monitoring method for an engineering rock mass, in which the borehole fracture-deformation-wave velocity integrated intelligent sensing apparatus for the engineering rock mass is adopted, wherein the method includes the following steps:

step 1: a borehole 10 is machined in a side wall of a tunnel, next, a plurality of cable guide pulleys 17 are disposed in a height direction of the side wall of the tunnel under the borehole 10, then, an equipment cabinet 14 is installed on the tunnel ground under the borehole 10, and then, an industrial personal computer and a cable reel are installed on the equipment cabinet 14;

step 2: one end of a cable 1 is connected to a hole-diameter-adaptive crawling robot 2, on the other end of the cable 1, cable lines 12 are connected to the industrial personal computer by the cable reel, and then, a combined multifunctional probe assembly is installed on a front end of the hole-diameter-adaptive crawling robot 2;

step 3: a power supply is turned on, and the industrial personal computer, the hole-diameter-adaptive crawling robot 2 and the combined multifunctional probe assembly are debugged to ensure normal work and also ensure that the industrial personal computer can be normally and remotely connected to a master control system in a tunnel supervision room;

step 4: the hole-diameter-adaptive crawling robot 2 installed with the combined multifunctional probe assembly is put into the borehole 10, and then, two lift-type electric crawler walking mechanisms 9 of the hole-diameter-adaptive crawling robot 2 are controlled to unfold in the radial direction until the hole-diameter-adaptive crawling robot 2 is stably supported on a wall of the borehole 10 by means of a friction;

step 5: a monitoring starting instruction is remotely sent by the master control system in the tunnel supervision room, after receiving the instruction, the hole-diameter-adaptive crawling robot 2 starts to advance at a constant speed in the axial direction of the borehole 10, during movement, borehole fracture is monitored by a high-definition wide-angle camera 4, at the same time, borehole deformation is monitored by a laser radar probe 5, and after the hole-diameter-adaptive crawling robot 2 moves to the bottom of the hole, information collection is ended, and the hole-diameter-adaptive crawling robot 2 is controlled to retreat to an orifice;

step 6: firstly, the orifice of the borehole 10 is plugged to seal the hole-diameter-adaptive crawling robot 2 in the borehole 10, then, clear water is injected into the sealed borehole 10 by a water pipe 13 until the borehole 10 is filled with the clear water, then, the monitoring starting instruction is further remotely sent by the master control system in the tunnel supervision room, the hole-diameter-adaptive crawling robot 2 advances in water at a constant speed in the axial direction of the borehole 10, during movement, a borehole wave velocity is monitored by an acoustic transceiver probe 6, and after the hole-diameter-adaptive crawling robot 2 moves to the bottom of the hole, information collection is ended, and the hole-diameter-adaptive crawling robot 2 is controlled to retreat to the orifice;

step 7: firstly, water in the borehole 10 is drained, next, the orifice of the borehole 10 is unplugged, then, the two lift-type electric crawler walking mechanisms 9 of the hole-diameter-adaptive crawling robot 2 are controlled to retract in the radial direction to remove support and fixation between the hole-diameter-adaptive crawling robot 2 and the wall of the borehole 10, then, the hole-diameter-adaptive crawling robot 2 and the combined multifunctional probe assembly are moved out of the borehole 10, and finally, data collected by the master control system in the tunnel supervision room is analyzed and processed.

The solution in the embodiment is not intended to limit the patent protection scope of the present disclosure. All equivalent implementations or alterations made without departing from the present disclosure fall within the patent scope of the solution.

What is claimed is:

1. A borehole fracture-deformation-wave velocity integrated intelligent sensing apparatus for an engineering rock mass, the apparatus comprising:

an in-hole monitoring execution unit; and an out-hole monitoring unit connected to the in-hole monitoring execution unit by a cable;

wherein the in-hole monitoring execution unit comprises a hole-diameter-adaptive crawling robot and a combined multifunctional probe assembly, the combined multifunctional probe assembly being connected to a front end of the hole-diameter-adaptive crawling robot by a quick joint having a male end and a female end, a rear end of the hole-diameter-adaptive crawling robot being connected to the cable;

wherein the combined multifunctional probe assembly comprises a high-definition wide-angle camera, a laser radar probe, and an acoustic transceiver probe; the male end of the quick joint is fixedly mounted on the high-definition wide-angle camera, and the female end of the quick joint is fixedly mounted on the hole-diameter-adaptive crawling robot; the high-definition wide-angle camera is sealingly disposed within a transparent protective cover; and the laser radar probe and the acoustic transceiver probe are connected in series and fixed to a front end of the transparent protective cover by an adapter, or the laser radar probe and the acoustic transceiver probe are each independently fixed to the front end of the transparent protective cover by one or more adapters;

wherein the hole-diameter-adaptive crawling robot comprises:

a robot body having a waterproof sealed shell defining a sealed cavity therein; and two lift-type electric crawler walking mechanisms configured to enable hole-diameter-adaptive crawling movement of the hole-diameter-adaptive crawling robot within a borehole, each of the two lift-type electric crawler walking mechanisms having a respective waterproof sealed shell structure;

wherein an air pressure sensor is disposed within the robot body, and a charging nozzle is disposed on a rear portion of the shell of the robot body, the sealed cavity being in fluid communication with an interior of the transparent protective cover and being charged to a pressure value of 1.2 bar to 1.6 bar;

wherein the air pressure sensor is configured to detect, in real time, a pressure value within the sealed cavity and to transmit measured pressure data to the out-hole monitoring unit via the cable, and wherein the out-hole monitoring unit is configured to generate an alarm when the detected pressure value falls below 1.2 bar;

wherein each of the two lift-type electric crawler walking mechanisms further comprises a controller and a force sensor, the force sensor being configured to detect, in real time, a supporting force N exerted by the respective lift-type electric crawler walking mechanism against a wall of the borehole, and the controller being configured to:

receive measured data from the force sensor, convert the supporting force N into a real-time friction force F between the respective lift-type electric crawler walking mechanism and the wall of the borehole, compare the real-time friction force F against a predetermined minimum allowable friction force $F_{min}$ stored in the controller, and when $F<F_{min}$, increase the supporting force N until $F>F_{min}$;

wherein the cable has an integrated structure comprising cable lines and a water pipe disposed within a sheath, the cable lines being configured to transmit control instructions and monitoring data between the in-hole monitoring execution unit and the out-hole monitoring unit, and the water pipe being configured to convey water into the borehole;

wherein the out-hole monitoring unit comprises an equipment cabinet fixedly installed within a tunnel, the equipment cabinet housing an industrial personal computer connected to the cable lines, the industrial personal computer comprising a wireless data transmission module configured for remote connection to a master control system disposed in a tunnel supervision room; and wherein the master control system is configured to receive data generated by the hole-diameter-adaptive crawling robot and the combined multifunctional probe assembly via the cable lines and the industrial personal computer, and to collect data in at least three modes comprising: collection at equal time intervals, collection at designated input times, and continuous real-time collection.

2. A borehole fracture-deformation-wave velocity integrated monitoring method for an engineering rock mass, comprising:

(a) providing the apparatus of claim 1;

(b) forming the borehole in a side wall of the tunnel, disposing a plurality of cable guide pulleys along a height direction of the side wall below the borehole, installing the equipment cabinet on a ground surface of the tunnel below the borehole, and mounting the industrial personal computer and a cable reel in the equipment cabinet;

(c) connecting a first end of the cable to the hole-diameter-adaptive crawling robot, connecting a second end of the cable to the industrial personal computer via the cable reel, and installing the combined multifunctional probe assembly on the front end of the hole-diameter-adaptive crawling robot;

(d) powering on the industrial personal computer, the hole-diameter-adaptive crawling robot, and the combined multifunctional probe assembly, and establishing a remote connection between the industrial personal computer and the master control system in the tunnel supervision room;

(e) inserting the hole-diameter-adaptive crawling robot with the combined multifunctional probe assembly installed thereon into the borehole, and deploying the two lift-type electric crawler walking mechanisms radially outward until the hole-diameter-adaptive crawling robot is stably supported against the wall of the borehole by friction;

(f) remotely transmitting a monitoring start instruction from the master control system to the hole-diameter-adaptive crawling robot, advancing the hole-diameter-adaptive crawling robot at a constant speed along an axial direction of the borehole, monitoring borehole fracture with the high-definition wide-angle camera and monitoring borehole deformation with the laser radar probe during advancement, and upon reaching an end of the borehole, ceasing information collection and retreating the hole-diameter-adaptive crawling robot to a start orifice of the borehole;

(g) sealing the orifice of the borehole with a plug to enclose the hole-diameter-adaptive crawling robot within the borehole, injecting water into the borehole via the water pipe until the borehole is filled, remotely transmitting the monitoring start instruction from the master control system, advancing the hole-diameter-adaptive crawling robot at a constant speed along the axial direction of the borehole through the water, monitoring borehole wave velocity with the acoustic transceiver probe during advancement, and upon reaching the end of the borehole, ceasing collection and retreating the hole-diameter-adaptive crawling robot to the orifice; and (h) draining water from the borehole, removing the plug from the orifice, retracting the two lift-type electric crawler walking mechanisms radially inward to release the hole-diameter-adaptive crawling robot from the wall of the borehole, withdrawing the hole-diameter-adaptive crawling robot together with the combined multifunctional probe assembly from the borehole, and transmitting collected data to the master control system for analysis and processing.

* * * * *